US007673858B2

(12) United States Patent
Anderson et al.

(10) Patent No.: US 7,673,858 B2
(45) Date of Patent: Mar. 9, 2010

(54) LOW PRESSURE STEAM HUMIDIFIER

(75) Inventors: Wayne R. Anderson, Eden Prairie, MN (US); Brad A. Terlson, Maple Grove, MN (US); Charles E. Bartlett, Gilbert, AZ (US); Brian J. Ignaut, Ann Arbor, MI (US)

(73) Assignee: Honeywell International Inc., Morristown, NJ (US)

( * ) Notice: Subject to any disclaimer, the term of this patent is extended or adjusted under 35 U.S.C. 154(b) by 834 days.

(21) Appl. No.: 11/535,390

(22) Filed: Sep. 26, 2006

(65) Prior Publication Data

US 2008/0073802 A1 Mar. 27, 2008

(51) Int. Cl.
*B01F 3/04* (2006.01)

(52) U.S. Cl. ..... 261/118; 261/142; 261/DIG. 15; 261/DIG. 76

(58) Field of Classification Search ..... 261/115, 261/118, 141, 142, DIG. 10, DIG. 15, DIG. 65, 261/DIG. 76
See application file for complete search history.

(56) References Cited

U.S. PATENT DOCUMENTS

| | | | | |
|---|---|---|---|---|
| 2,587,834 | A * | 3/1952 | Goode | 43/57 |
| 3,319,046 | A | 5/1967 | Katzman et al. | |
| 3,610,879 | A | 10/1971 | Katzman | |
| 3,659,078 | A | 4/1972 | Rudstrom | |
| 3,689,037 | A * | 9/1972 | Payne | 261/105 |
| 3,714,392 | A | 1/1973 | Katzman et al. | |
| 3,855,371 | A * | 12/1974 | Morrow et al. | 261/100 |
| 3,898,976 | A * | 8/1975 | Coffman, Jr. | 126/113 |
| 4,132,883 | A | 1/1979 | Grime | |
| 4,211,735 | A * | 7/1980 | Berlin | 261/116 |
| 4,384,873 | A | 5/1983 | Herr | |
| 4,463,248 | A | 7/1984 | Katzman et al. | |
| 5,516,466 | A | 5/1996 | Schlesch et al. | |
| 5,543,090 | A | 8/1996 | Morton et al. | |
| 5,758,018 | A | 5/1998 | Fowler | |
| 5,942,163 | A | 8/1999 | Robinson et al. | |
| 6,019,820 | A * | 2/2000 | Leverett | 95/216 |
| 6,260,514 | B1 | 7/2001 | Ehling et al. | |
| 6,397,001 | B1 | 5/2002 | Montagnino et al. | |
| 6,398,196 | B1 | 6/2002 | Light et al. | |
| 6,488,219 | B1 | 12/2002 | Herr | |
| 6,560,408 | B2 | 5/2003 | Glucksman et al. | |

(Continued)

OTHER PUBLICATIONS

"Elite Steam Residential Steam Humidifers User Manual", *GeneralAire* at http://www.generalaire.com/cimages/New_Elite_Steam_Humidifers.pdf.pdf, undated.

(Continued)

*Primary Examiner*—Scott Bushey

(57) ABSTRACT

A humidifier for direct low pressure injection of steam into a duct. A source of steam is provided, and a steam tube is in fluid communication with the source of steam. A distal end segment of the steam tube is inclined with respect to the horizontal when the system is mounted to a duct to cause condensation within the steam tube to drain back to the source of steam under the force of gravity. The distal end of the steam tube includes an opening having a lip on an inside surface of the opening, where the lip directs condensation formed at the opening to flow back into the steam tube and back to the source of steam.

21 Claims, 7 Drawing Sheets

U.S. PATENT DOCUMENTS

| | | | | |
|---|---|---|---|---|
| 7,068,924 | B2 * | 6/2006 | Watanabe et al. | 392/386 |
| 2005/0150491 | A1 * | 7/2005 | Chen | 128/203.16 |

OTHER PUBLICATIONS

"Installation Instructions and Owner's Manual", *EWC Controls Inc*., at http://ewcconrols.com/acrobat/steam/s2000.pdf, dated 2003.

"Installation Instructions for Model 60-Series High Capacity Steam Humidifiers", *Skuttle Indoor Air Quality Products* at http://www.skuttle.com/OM/Skuttle60manual06.pdf, dated 2006.

"Model F60-1", *Skuttle Indoor Air Quality Products* at http://www.skuttle.com/f601.html, undated.

"Models S2000 & S2020" *EWC Controls, Inc*., at http://www.ewc-controls.com/steam_humidifier.htm, dated Jan. 20, 2006.

"Steam Humidifier Models 1150 and 1160", *Aprilaire*.

"The Best Humidifier Available", *Honeywell Automation and Control Solutions*, (2006).

Color picture of "Elite Steam Residential Steam Humidifers User Manual", *GeneralAire* at http://www.generalaire.com/cimages/New_Elite_Steam_Humidifers.pdf.pdf, undated., (Sep. 2006).

* cited by examiner

LOW PRESSURE STEAM HUMIDIFIER

FIELD OF THE INVENTION

The invention relates to humidification systems. More particularly, the invention relates to steam humidifier systems.

BACKGROUND OF THE INVENTION

The interior spaces of buildings are often at a lower than desired level of humidity. This situation occurs commonly in arid climates and during the heating season in cold climates. There are also instances in which special requirements exist for the humidity of interior spaces, such as in an art gallery or where other delicate items are stored, where it is desired that the interior humidity levels be increased above naturally occurring levels. Therefore, humidifier systems are often installed in buildings to increase the humidity of an interior space.

Humidification systems may take the form of free-standing units located within individual rooms of a building. More preferably, humidification systems are used with building heating, ventilation, and air conditioning (HVAC) systems to increase the humidity of air within ducts that is being supplied to interior building spaces. In this way, humidity can be added to the air stream at a centralized location, as opposed to having multiple devices that increase humidity at multiple points within the building interior. Additionally, because the air within ducts may be warmer than the interior space air during a heating cycle, the additional air temperature can help prevent the water vapor from condensing in the vicinity of the humidifier, such as on the inside of the duct.

Humidification systems are preferably inexpensive and easy to install. Generally, systems that require small holes in ducts are easier to install than systems that require large holes or cut-outs in ducts. A humidification system should also only discharge water vapor into the duct and not liquid water. Liquid water within a duct can create a number of serious problems. For example, liquid water that remains stagnant within a duct can promote the growth of mold or organisms that can release harmful substances into the air flow, potentially causing unhealthy conditions in the building. Liquid water can also cause rusting of a duct which can lead to duct failure, and can create leaks from the duct to the building interior spaces which are unsightly, can cause a slipping hazard, and can lead to water damage to the structure.

One known humidification method involves direct steam injection into an air duct of a building. This approach is most commonly used in commercial buildings where a steam boiler is present to provide a ready supply of pressurized steam. Although these direct steam injection systems work well to increase humidity within a duct, they suffer from the disadvantage that they require a drain to remove steam that condenses within the nozzle to prevent condensation from being propelled into the duct. The drain increases the complexity and cost of the installation. The presence of a drain may also increase the required maintenance of the system, such as if the drain were to become plugged. Alternatively, some applications use a heated nozzle to prevent condensation from forming in the nozzle. This also increases the cost of the system, as well as increases energy consumption. Pressurized steam injection systems are also associated with a risk of explosion of the steam pressure vessels as well as a risk of possibly burning nearby people, both of which are very serious safety concerns.

In residential applications, there is usually no readily available source of pressurized steam. An open bath humidifier system may be used, however these are difficult to install because they require a large hole in the duct and can only be used with horizontal or upflow ducts. Alternatively, a residential application may use direct steam injection, but this requires a separate unit to generate pressurized steam and this separate unit is costly. Moreover, the system would suffer from the same disadvantages as are present in commercial direct steam injection systems, namely, the requirement of a drain to remove condensate or the use of a heated nozzle.

Improved humidification systems are desired.

SUMMARY OF THE INVENTION

The invention provides a humidifier having a source of steam and a steam tube connected to the source of steam. The steam tube is inclined relative to the horizontal so that condensation that forms within the steam tube will tend to drain back to the source of steam rather than being propelled as liquid water into the duct. The tip of the steam tube also has an opening that includes a lip or bevel on an inside surface of the opening, so that any condensation is collected in the steam tube rather than being expelled from the steam tube and is directed back to the source of the steam.

The invention may be more completely understood by considering the detailed description of various embodiments of the invention that follows in connection with the accompanying drawings.

Figure 1:
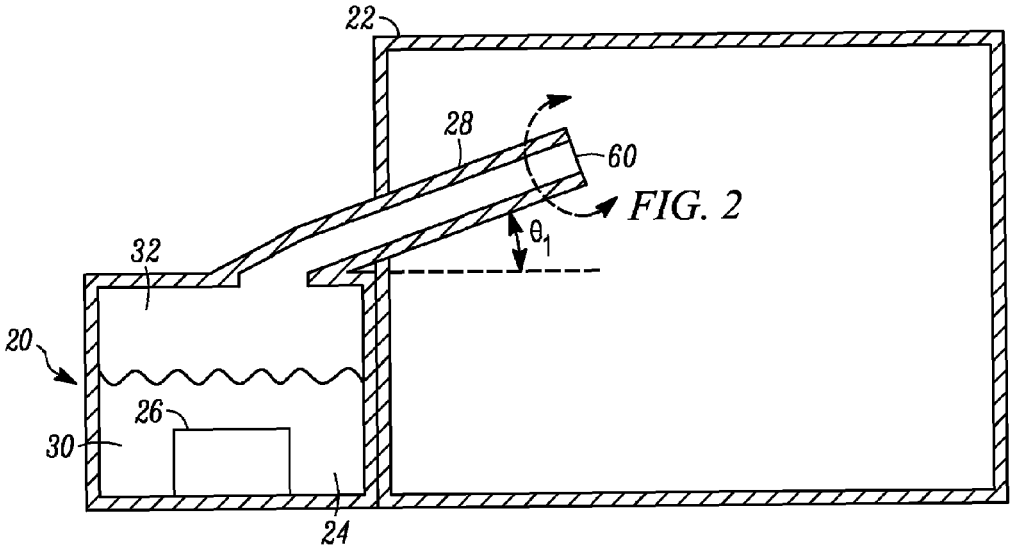
FIG. 1 is a cross sectional view of a humidifier constructed according to the principles of the present disclosure.

While the invention may be modified in many ways, specifics have been shown by way of example in the drawings and will be described in detail. It should be understood, however, that the intention is not to limit the invention to the particular embodiments described. On the contrary, the intention is to cover all modifications, equivalents, and alternatives following within the scope and spirit of the invention as defined by the claims.

DETAILED DESCRIPTION OF THE INVENTION

The present invention provides a low pressure direct steam injection humidifier system that is constructed to reduce the occurrence of condensate being expelled into the duct.

A simplified cross-sectional view of a humidifier constructed according to the principles of the present invention is shown in FIG. 1. Humidifier 20 is positioned on duct 22, where duct 22 is configured to contain air flow received from an HVAC device such as a furnace. Humidifier 20 includes a water tank 24, a heater 26 within water tank 24, and a steam tube 28 fluidly connecting water tank 24 to the interior of duct 22. The components in contact with water such as water tank 24 preferably are constructed from a non-metallic material in order to reduce the potential for corrosion. For example, the non-metallic material may be plastic capable of resisting high temperatures and stresses. One possibly usable plastic may be polycarbonate.

In operation, water tank 24 is at least partially filled with water, creating a water region 30 of tank 24 and a vapor space 32 above water region 30 within tank 24. In one embodiment, tank 24 preferably has a water capacity of about 1 gallon. In an alternative embodiment, tank 24 has a water capacity of more than 0.25 gallons, or alternatively, less than 5 gallons. Water within water region 30 is heated by heater 26 to boiling (approximately 100° C. depending on atmospheric pressure). Heater 26 is preferably an electrical heater. Water vapor, or steam, forms within water tank 24 in vapor space 32. Vapor space 32 is fluidly connected to steam tube 28. The process of generating steam may cause a slight increase in the pressure within space 32 relative to the atmosphere, generally less than 5 psi. This pressure within space 32 generally is greater than the pressure in duct 22. Therefore, steam tends to flow from space 32 into steam tube 28 and then into duct 22.

Figure 2:
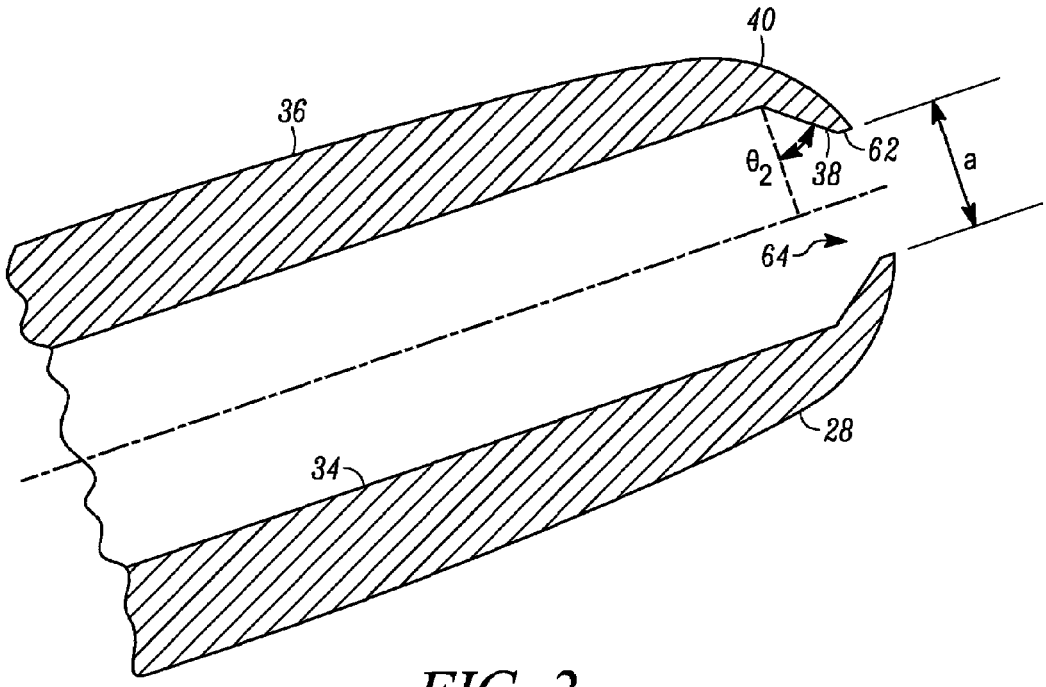
FIG. 2 is a close up sectional view of the exit, or distal, end of one embodiment of the steam tube of the humidifier of FIG. 1.

As shown in FIG. 2, steam tube 28 is characterized by an inside surface 34 and an outside surface 36. Steam tube 28 preferably has a round cross-section; however, other cross-sectional configurations are usable. Furthermore, other than immediately adjacent to the discharge end, steam tube 28 preferably has a cross-section of constant size; however, the cross-section of steam tube 28 may also be increasing or decreasing along the length of steam tube 28. In an embodiment, the inner and outer diameters of steam tube 28 increase gradually moving toward the end attached to the humidifier to accommodate a molding process. Where steam tube 28 has a round cross-section, it can be characterized by an inner diameter and an outer diameter. In one embodiment, steam tube 28 preferably has an inner diameter of 0.85 inches (21.6 mm) and an outer diameter of 1 inch (25.4 mm). Alternatively, steam tube 28 inner diameter may be at least ¼ inch (6.4 mm), or alternatively may be at least ½ inch (12.7 mm), and/or alternatively may be no more than 1.5 inches (38.1 mm). Steam flowing through steam tube 28 is in contact with inside surface 34. However, air flowing within duct 22 is in contact with outside surface 36. Since air flowing within duct 22 is typically less than 100° C., this air tends to cool steam tube 28 to less than 100° C. When steam within steam tube 28 contacts the interior surfaces 34, some steam will tend to condense on the interior surfaces to form liquid water.

It is desired that this liquid water not be expelled into the duct. The steam has a flow velocity through the steam tube 28, however, and may tend to carry the condensed liquid water with it. The steam tube 28 is designed to counteract this effect. The steam tube is positioned at an inclined angle relative to the horizontal so that liquid water that accumulates on the inner surface 34 of steam tube 28 will tend to drain back down the steam tube under the force of gravity and be returned to the tank 24. The steam tube 28 is inclined to the horizontal by less than 90 degrees, as indicated in FIG. 1 by angle $\theta_1$. In one embodiment, angle $\theta_1$ is preferably about 30 degrees. In another embodiment, angle $\theta_1$ is at least 10 degrees, or alternatively at least 15 degrees, and/or alternatively at most 45 degrees. This arrangement allows condensate to drain to the source of steam without necessarily requiring an additional drain to be installed in the duct or the steam tube.

Figure 4:
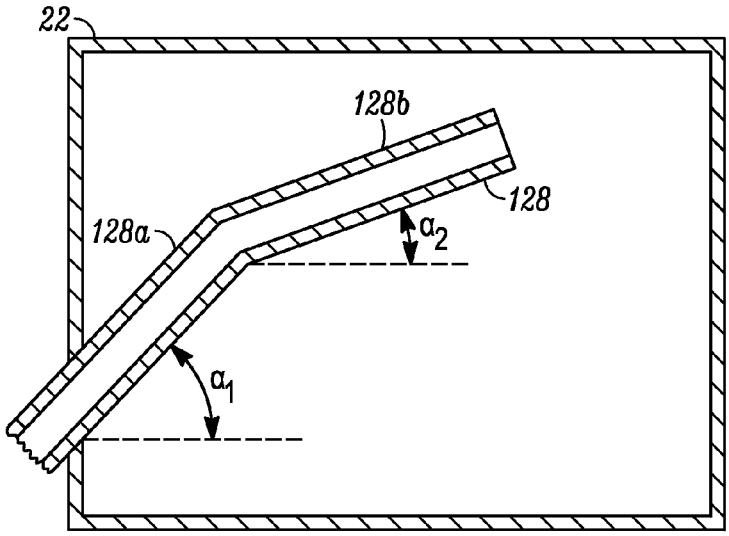
FIG. 4 is a close up sectional view of an alternative embodiment of a steam tube within a duct.

In another embodiment, a steam tube 128 may be inclined to the horizontal at multiple or compound angles. For example, FIG. 4 shows a close-up of an embodiment of steam tube 128 at multiple angles within duct 22. This arrangement is particularly useful where duct 22 is small or steam tube 128 must be mounted close to the top of duct 22. Steam tube 128 is characterized by a first segment 128*a* and a second segment 128*b*, which may also be called proximal end segment 128*a* and distal end segment 128*b*. First segment 128*a* is shown in FIG. 4 as positioned at angle $\alpha_1$ with respect to the horizontal, and second segment 28*b* is shown as positioned at angle $\alpha_2$ with respect to the horizontal. In one embodiment, $\alpha_2$ is preferably less than $\alpha_1$. In another example embodiment $\alpha_1$ is preferably 30 degrees and $\alpha_2$ is preferably 15 degrees. In yet another embodiment, angle $\alpha_1$ is at least 10 degrees and $\alpha_2$ is at least 15 degrees, or alternatively, angle $\alpha_1$ is at least 15 degrees and $\alpha_2$ is at least 20 degrees, or alternatively angle $\alpha_1$ is at most 60 degrees and $\alpha_2$ is at most 45 degrees. In FIG. 4, the centerlines of both segments of steam tube 128 are shown in the same plane (the plane of the paper). Alternatively, the segments could also be at compound angles with respect to each other, such that both segments are not in a horizontal plane when the tube is positioned in the duct, so long as both segments are inclined with respect to the horizontal.

Various embodiments of humidifier 20 may include various combinations of the features disclosed herein. For example, different steam tube configurations are possible, such as steam tube 28 and steam tube 128. For convenience, additional features will be described with reference only to steam tube 28, but it is to be understood that these additional features are equally applicable to other steam tube embodiments such as steam tube 128 or other steam tube embodiments that are discussed herein.

The inner diameter associated with inside surface 34 of steam tube 28 is designed to be sufficiently large in diameter so that the steam velocity is sufficiently low within the steam tube that the steam will not tend to entrain liquid water or otherwise carry the liquid water out of the steam tube. The inner diameter of steam tube 28 is sized based on the system steam generation capacity and the rate at which steam is generated, which is primarily a function of the power level of the heater 26 and the dimensions of tank 24. For example, where heater 26 is approximately 1000 watts, and where tank 24 holds approximately 1 gallon of water, steam tube 28 preferably has an inner diameter of about 0.85 inches (about 21.6 mm) with an outer diameter of approximately 1 inch (25.4 mm).

Steam tube 28 may also include additional features for preventing water from being discharged into the duct 22. As seen in FIG. 2, steam tube 28 includes a lip 38 at the inside exit point 60, also called the distal end 60, of steam tube 28. Lip 38 may also be called a step, bevel, or chamfer. Lip 38 is characterized by a narrowing of the flow passage within steam tube 28 at the exit 60, such that lip 38 extends into the interior of the flow passage within steam tube 28, causing the flow passage diameter to be reduced with respect to the diameter of inside surface 34. Lip 38 defines an opening 64 through which steam flows before exiting steam tube 28. Lip 38 acts by capillary action to prevent condensate that has formed within steam tube 28 from being expelled from the steam tube and instead causes the condensate to drain down inside surface 34 and back to tank 24.

Figure 3:
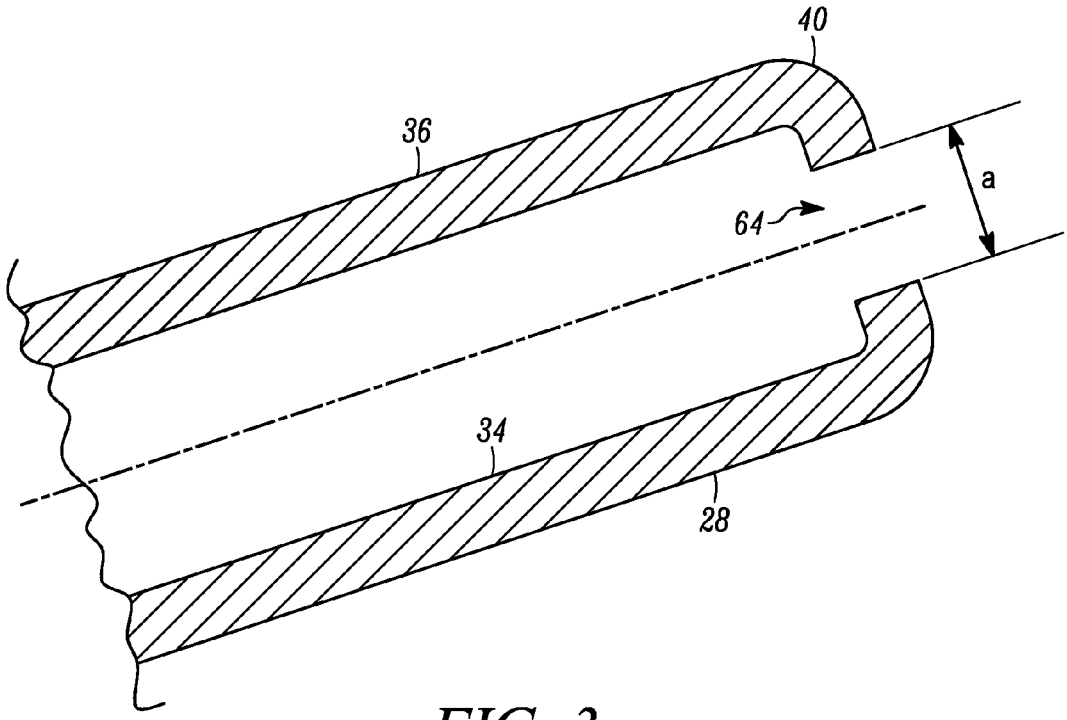
FIG. 3 is a close up sectional view of an alternative embodiment of the distal end of a steam tube.

Many embodiments of lip 38 are usable. In one usable embodiment, lip 38 forms an angle with respect to a radius perpendicular to the centerline of steam tube 28, as shown in FIG. 2 as $\theta_2$. In one embodiment, $\theta_2$ is preferably 45 degrees. Alternatively, $\theta_2$ is 25 degrees or greater, or alternatively $\theta_2$ is 75 degrees or less. In the embodiment shown in FIG. 2, lip 38 forms surface 62 at the innermost portion. Alternatively, lip 38 could form a radiused surface at the innermost portion. In another usable embodiment shown in FIG. 3, lip 38 is a step in diameter of inner surface 34 at exit 60, so that $\theta_2$ is 90 degrees. In such an embodiment, lip 38 may form a straight surface (as viewed in a cross section) at the innermost portion. In another embodiment, lip 38 forms a radius that extends from interior 34 into the flow passage within steam tube 28. Other geometrical configurations of lip 38 are usable. In one embodiment, where the steam tube 28 inner diameter is 0.85 inches (21.6 mm), the opening 64 in distal end 60 through the lip 38 is 0.54 inches (13.7 mm) (dimension "a" in FIG. 2). In another embodiment, the opening 64 through lip 38 is 0.3 inches (7.6 mm). Alternatively, opening 64 may be 0.25 inches (6.4 mm) or more, or alternatively may be 0.5 inches (12.7 mm) or more, or alternatively may be 1 inch (25.4 mm) or less.

Figure 5:
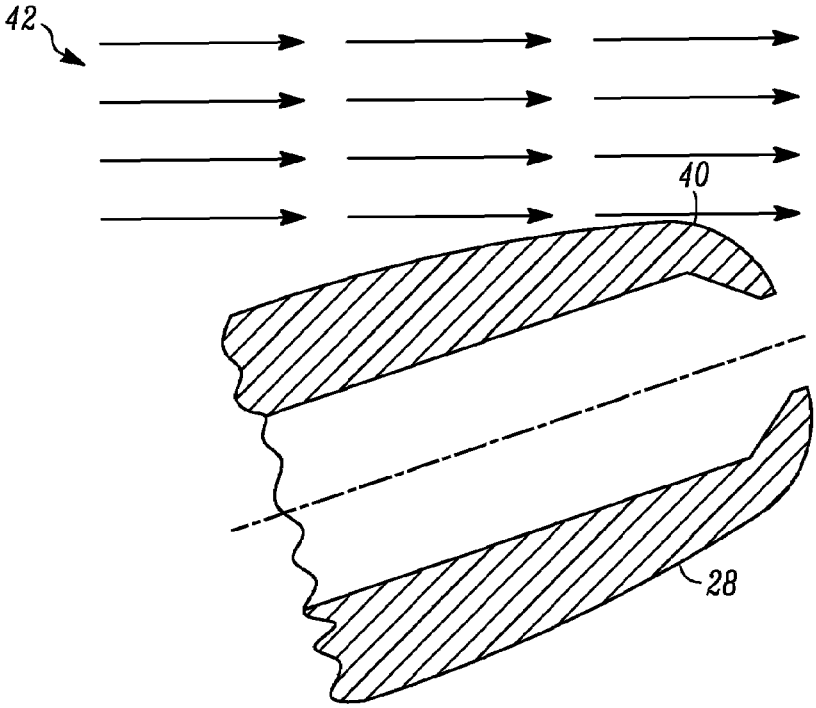
FIG. 5 is an air flow velocity diagram showing the air flow around a steam tube constructed according to the principles of the present disclosure.
Figure 6:
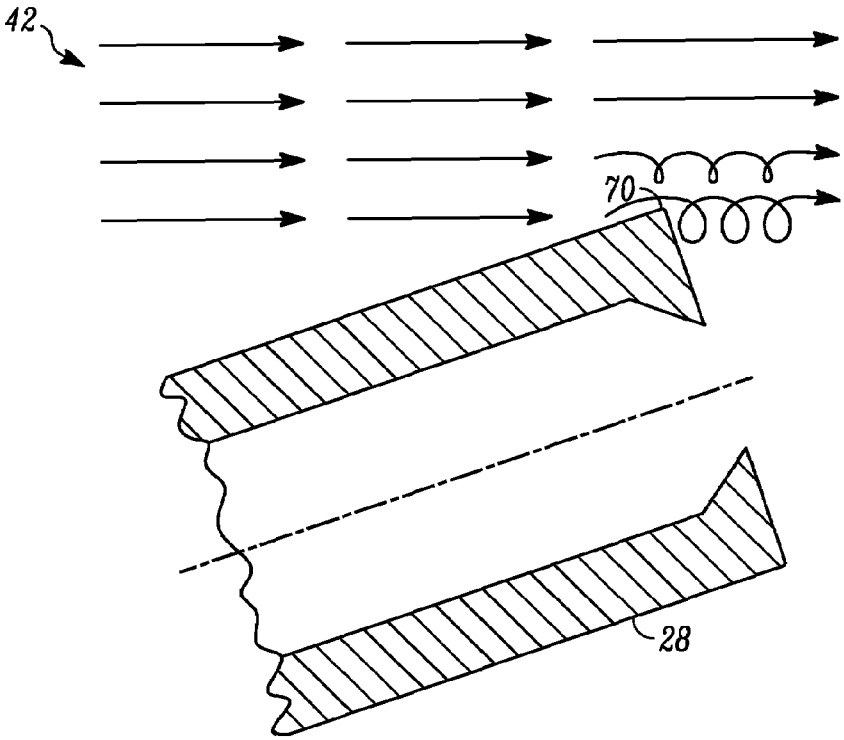
FIG. 6 is an air flow velocity diagram showing the air flow around a steam tube constructed with a sharp edge.

Steam tube 28 may further include rounded outer edge 40 at the distal end 60 to help prevent condensate from being discharged from the steam tube 28. As shown in FIG. 5, rounded outer edge 40 helps to prevent a localized depressurization at the outlet of steam tube 28 that would tend to pull condensate out of the steam tube. Air 42 flowing within duct 22 can be represented by velocity vectors representative of its direction and velocity. As air 42 approaches steam tube 28, some of the air must take a longer path in order to get around the steam tube which causes its velocity to increase in order to maintain the same bulk flow rate. Because the energy within the flow stays constant, the higher velocity of the flow causes its pressure to drop in the local high velocity area. This can be called a venturi effect, and if uncontrolled, could create a low pressure zone right at the exit of steam tube 28. Such a low pressure zone would might tend to cause condensate within steam tube 28 to be drawn out of steam tube 28, rather than running down inside surface 34 and returning to tank 24. By including rounded outer edges 40 on steam tube 28, as seen in FIG. 5, this effect is minimized and the flow stays mostly laminar. FIG. 6 indicates the possible consequences of having a sharp edge 70 instead of rounded edge 40, and shows how the flow distance increases and the possible creation of turbulence at the outlet of steam tube 28, leading to increased pressure loss at the exit of steam tube 28. Rounded outer edge 40 preferably comprises a radius of at least ¼ of the outer diameter radius of the steam tube 28. However, it is also possible for a steam tube having a sharp edge 70 or only a slight radius at edge 70 to perform well.

Figure 7:
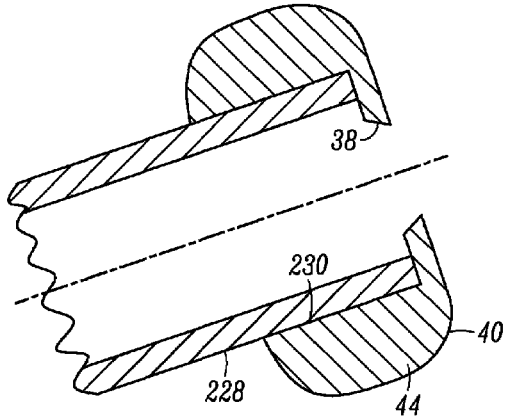
FIG. 7 is a close up sectional view of one embodiment of the distal end of a steam tube having a cap.

An alternative embodiment of the exit end of a steam tube 228 is shown in FIG. 7. Steam tube 228 further comprises cap 44 secured to the distal end 230. Cap 44 includes a lip 38 as discussed above. Cap 44 may also include a rounded outer edge 40, also as discussed above. Cap 44 advantageously allows lip 38 and rounded outer edge 40 to be created on steam tube 228 when steam tube 228 is constructed from tubing or piping having a generally constant cross sectional diameter.

Figure 8:
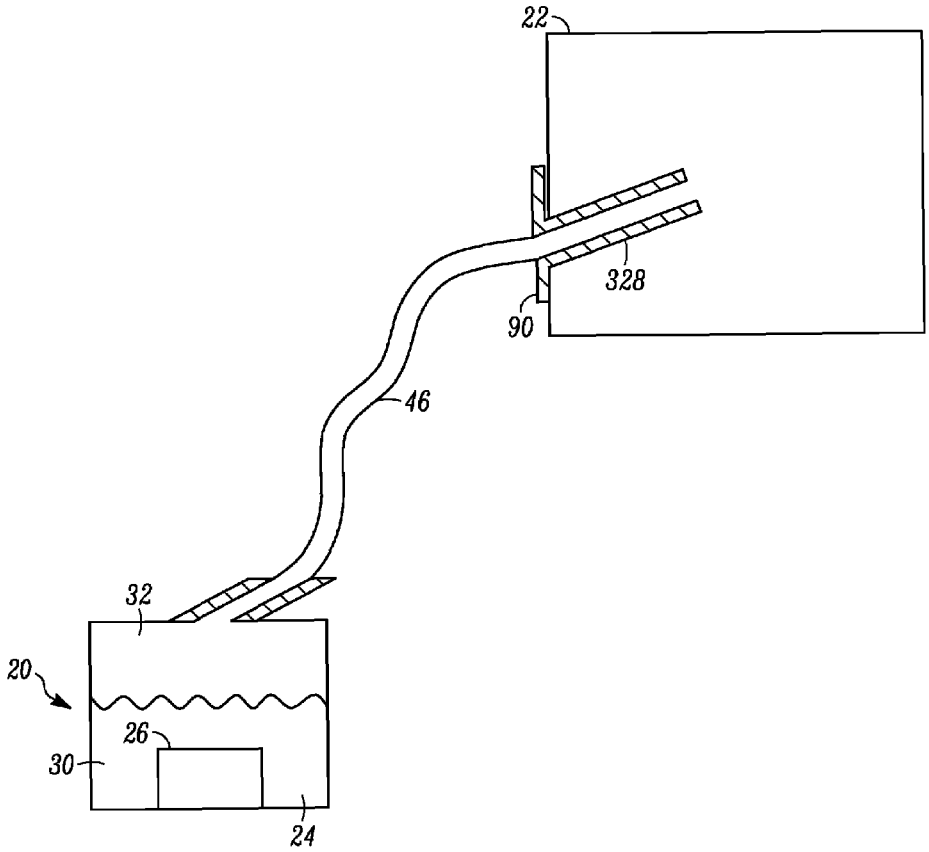
FIG. 8 is a cross-sectional view of a humidifier having a tube connecting the steam generator to the steam tube.

Yet another embodiment is depicted in FIG. 8. In some instances, it may be preferable to mount certain components of humidifier 20 remotely from duct 22. For example, duct 22 may be located high above the floor or duct 22 may be in a confined location. The embodiment of FIG. 8 allows the water tank 24, heater 26, and associated elements to be mounted remotely from duct 22. Steam tube 328 is fluidly connected to tank 24 and vapor space 32 by way of tubing 46. In one embodiment, tubing 46 comprises flexible tubing. Steam tube 328 is modified to include a means for separately mounting to the duct, such as flange 90 depicted in FIG. 8. Tubing 46 is configured during installation so that it is positioned at an inclined angle with respect to the horizontal along its entire length. The tubing 46 is to be installed so that no section is horizontal or declined with respect to the horizontal. For the same reasons discussed above with respect to steam tube 28, this inclined mounting causes condensation within tubing 46 or steam tube 328 to drain down the tubing 46 and into tank 24. The tubing 46 can be any length necessary to connect the tank 24 and associated components to the duct 22. For example, tubing 46 is 3 to 12 feet in length in an embodiment. In another embodiment, tubing is 20 feet in length or less.

Figure 9:
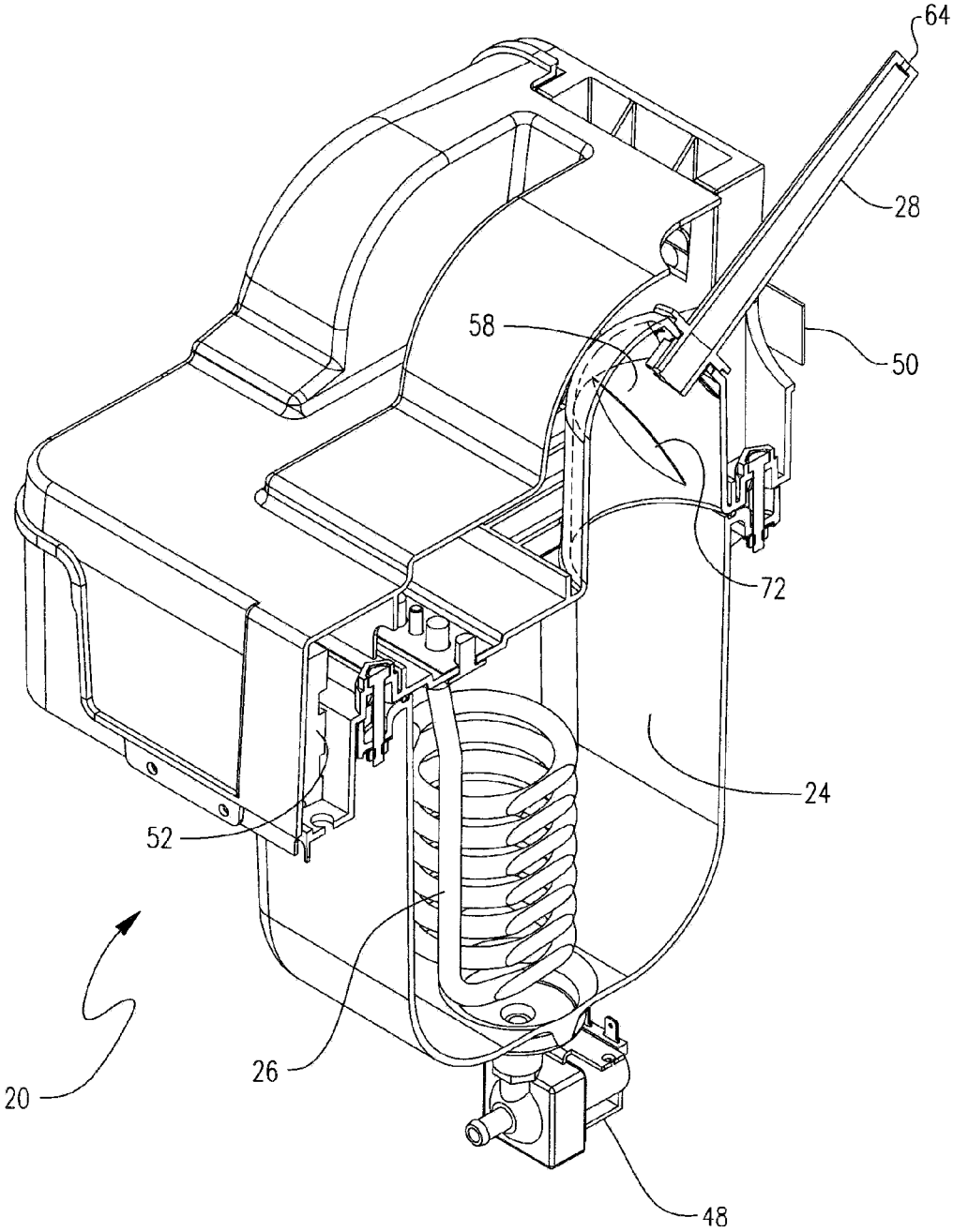
FIG. 9 is a cut away perspective view of an embodiment of a humidifier.

A cutaway view of one possible embodiment of a humidifier system 20 is shown in FIG. 9. Humidifier 20 includes a water tank 24, a heater 26, and a steam tube 28. The humidifier 20 also includes a water inlet valve (not shown) for regulating the inflow of water from a supply line into tank 24 and a water drain valve 48 for regulating an outflow of water from tank 24 to a drain. In one embodiment, the water inlet valve is separated from tank 24 by a baffle or other divider to minimize splashing within tank 24. Mounting bracket 50 is configured to attach humidifier 20 to a duct. A controller 52 is provided to control the various functions of the humidifier 20. For example, controller 52 may interface with a humidistat to cycle the humidifier on and off in response to the humidification needs of the interior building space and the desired level of humidity set by occupants. Controller 52 may also interface with an HVAC system fan or flow sensor so that steam is only generated when a fan is energized or there otherwise is air flowing within the duct. Controller 52 may also provide other maintenance functions, such as a routine flushing of the water tank 24. Controller 52 may monitor the temperature at locations on the humidifier as an indication of humidifier performance, and may, for example, turn off the heater if it is apparent that humidifier 20 is overheating.

The embodiment shown in FIG. 9 further includes dome 58 located between the water tank 24 and steam tube 28. Dome 58 partially defines vapor space 32, along with the space above water region 30 within tank 24. Dome 58 provides a region for transitioning and directing steam from the water interface to the steam tube 28. By increasing the distance between water region 30 and the steam tube 28, dome 58 helps to prevent liquid water from tank 24 from splashing into steam tube 28, and also helps to prevent any foam that forms at the water surface from entering steam tube 28. Dome 58 also has a relatively large cross-sectional area relative to steam tube 28, such that the steam has relatively low velocity within dome 58 as it travels to steam tube 28. Maintaining a relatively low steam velocity in dome 58 also helps to prevent liquid water from being entrained within the steam and carried from water region 30 into steam tube 28. In this manner, dome 58 helps to prevent liquid water from being expelled into duct 22 while also allowing the components of humidifier 20 to be packaged in a space-efficient manner.

Many embodiments of dome 58 are usable. Dome 58 may or may not be hemispherical. In one embodiment, dome 58 has a generally round cross section. In another embodiment, dome 58 has a cylindrical portion and a hemispherical portion. In another embodiment, dome 58 is generally cylindrical. In yet another embodiment, dome 58 is generally hemispherical. Another usable embodiment of dome 58 has a square or rectangular cross-section. In one embodiment, dome 58 is about 3 inches in height (75 mm) and about 2 inches (50 mm) in diameter. In another embodiment, dome 58 is at least 1 inch in height (25 mm) and ½ inch in diameter (13 mm), and in another embodiment dome 58 is at most 6 inches in height (152 mm) and 6 inches in diameter (152 mm). In an embodiment, dome 58 is configured to support the steam tube so that a distance from the water within tank 24 to the steam tube 28 is at least 3 inches, or in another embodiment, a distance of at least 4 inches.

Humidifier 20 may further include a steam baffle 72. Baffle 72 serves to help prevent water in tank 24 from splashing into steam tube 28 and helps to prevent foam on the surface of the water from traveling into steam tube 28 and duct 22. Baffle 72 may be located anywhere within vapor space 32 between the water in tank 24 and the entrance to steam tube 28, and baffle 72 may also be many different shapes and sizes. For example, baffle 72 may be located within dome 58 proximate to the entrance to steam tube 28, or may be located within vapor space 32 in tank 24 proximate to the entrance to dome 58. In one embodiment, baffle 72 is configured to cause the steam to change flow direction at least one time before entering the steam tube 28. In this way, vapor phase water can easily be carried through this path and enter into steam tube 28, while liquid phase water or foam cannot.

In one embodiment, baffle 72 is a plate positioned between the water in tank 24 and the entrance to stream tube 28. The plate includes openings in an embodiment.

Figure 11:
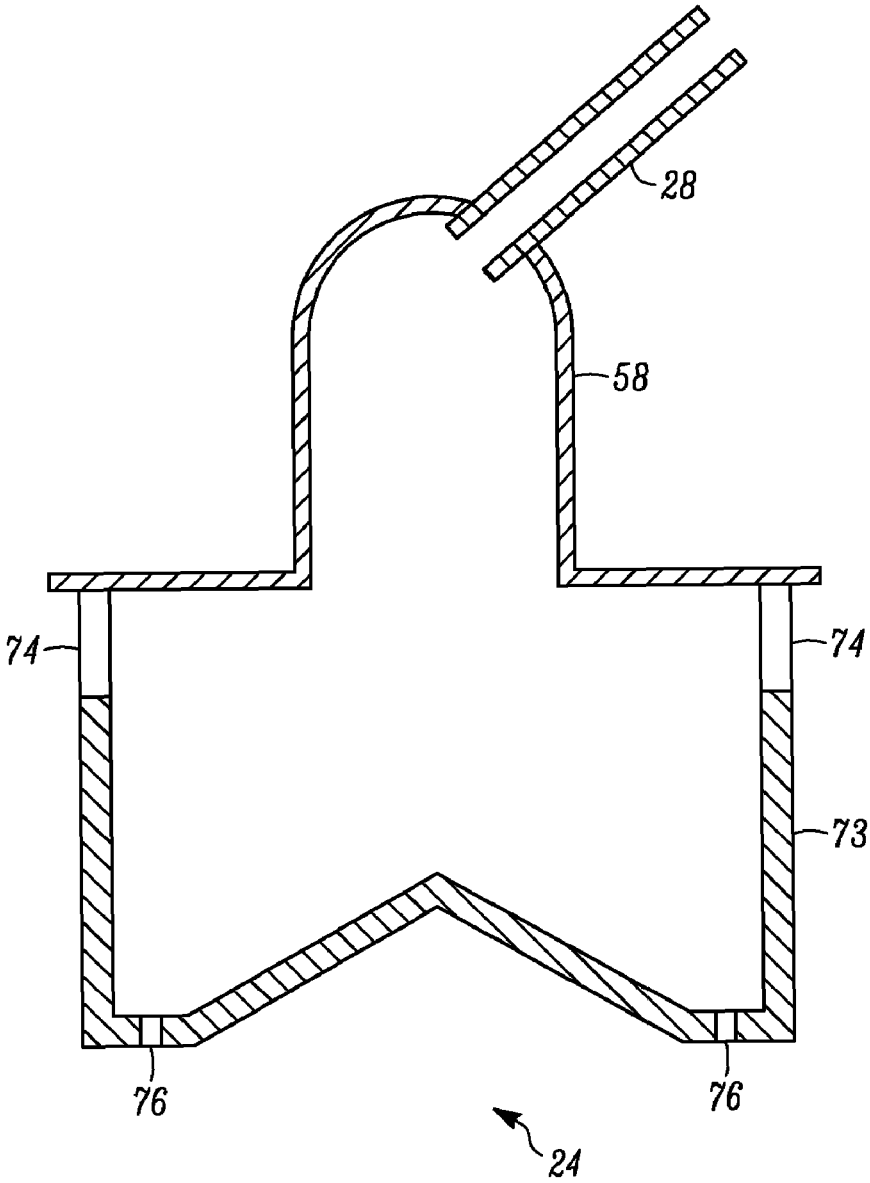
FIG. 11 is a cross-sectional view of a baffle.

Another embodiment of a baffle 73 is shown in FIG. 11, where baffle 73 is generally cup-shaped, having a plurality of openings 74 for allowing the passage of steam from tank 24 to dome 58 and steam tube 28. Baffle 73 also is shown as having a plurality of drain holes 76 for allowing condensate that collects inside of baffle 73 to drain back to tank 24. Baffle 73 is constructed so that condensate will be directed under the force of gravity to drain holes 76. An alternative embodiment of baffle 73 consists of a fine screen with openings smaller than that of the water droplets that might be ejected from the surface of the boiling water, such that vapor phase water would easily pass through the screen but liquid water would not. The baffle and dome tend to function together to help prevent liquid water from entering steam tube 28. In one embodiment, having a baffle allows dome 58 to be smaller while still adequately preventing liquid water from entering steam tube 28, thereby also allowing a smaller overall size for humidifier 20. Alternatively, in some embodiments dome 58 may be large enough to adequately prevent liquid water from entering steam tube 28 without having a baffle.

Humidifier 20 may also include a water level sensor. The water level sensor may be configured so that if the water level drops to less than a pre-selected value, then a signal is sent to the controller 52. Controller 52 can then turn off the heater until the water level is restored in order to prevent the tank 24, heater 26 itself, or other components from being heated to a very high temperature and possibly causing component failure.

Figure 10:
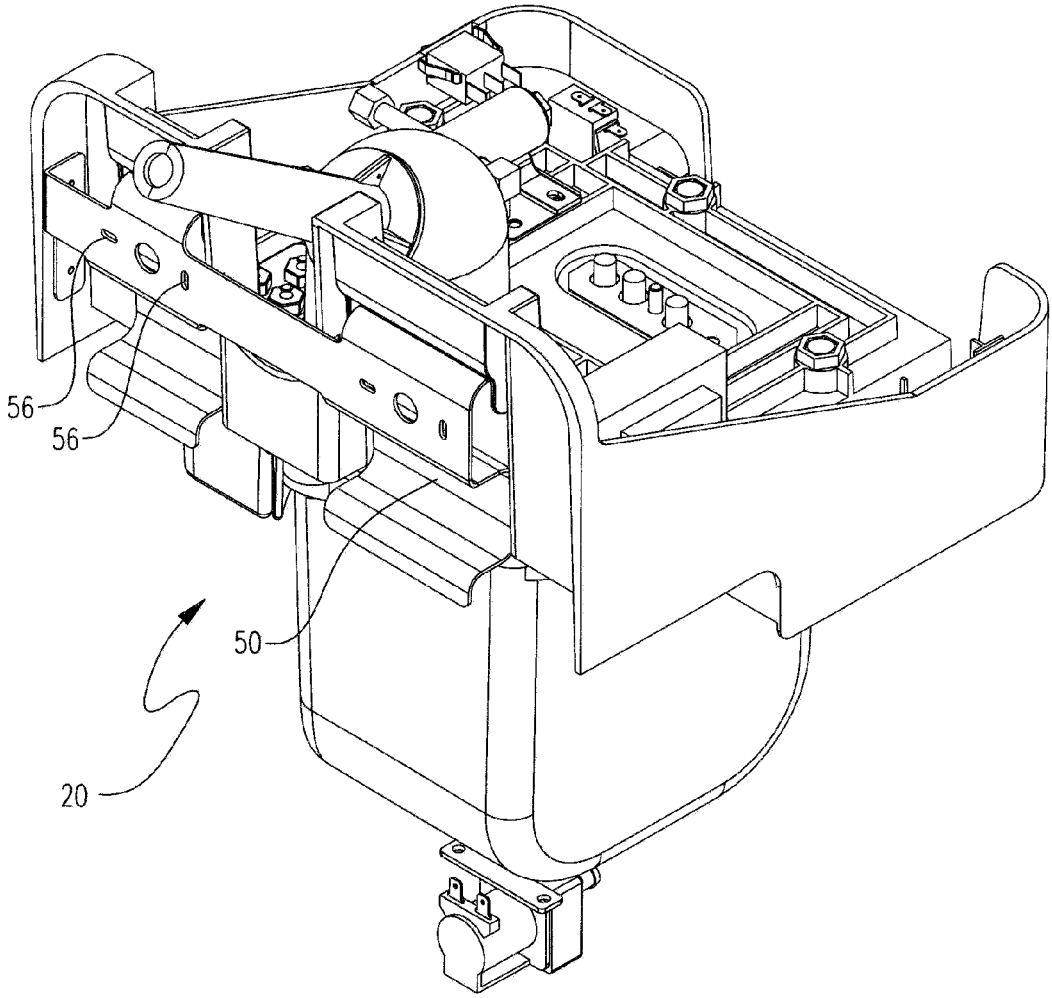
FIG. 10 is a perspective view of a humidifier having a mounting bracket.

Humidifier 20 can be configured to be mounted on a duct 22. FIG. 10 shows a side view of humidifier 20 having a mounting bracket 50. Mounting bracket 50 includes a plurality of mounting holes 56. To mount humidifier 20 on a duct, a user would secure mounting bracket 50 to the duct by the use of screws, bolts, or other fasteners through mounting holes 56. The user would also form a hole in the duct to receive steam tube 28. For example, this hole may be 1 inch in diameter or slightly larger to receive an approximately 1 inch in diameter steam tube 28. Finally, the user would insert the steam tube 28 through the hole made in the duct and secure the humidifier 20 onto mounting bracket 50. Any necessary water supply or drain connections could then be made, as well as any necessary electrical power supply and system control wires.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the present specification. The claims are intended to cover such modifications and devices.

The above specification provides a complete description of the structure and use of the invention. Since many of the embodiments of the invention can be made without parting from the spirit and scope of the invention, the invention resides in the claims.

What is claimed is:

1. A steam humidifier system, configured to inject steam into a duct, comprising:

(a) a source of steam;

(b) a steam tube in fluid communication with the source of steam, the steam tube comprising:

(i) a distal end segment that is configured to be inclined relative to the horizontal at an angle of less than 90 degrees when the system is mounted to a duct, wherein condensation that forms in the distal end segment drains back through the steam tube to the source of steam; and (ii) the distal end segment defining an opening having a lip on an inside surface of the opening, wherein the lip directs condensation formed at the opening to flow back into the steam tube and back to the source of the steam.

2. The system of claim 1 wherein the steam tube has a narrowest inner diameter of at least ¼ inch.

3. The system of claim 1 wherein the steam tube passes through an opening in a duct.

4. The system of claim 1 wherein the source of steam comprises:

a reservoir for holding water; and a heater positioned in the reservoir, wherein condensation formed in the steam tube flows back to the reservoir.

5. The system of claim 4 further comprising a drain line that is in fluid communication with the steam tube and with the reservoir.

6. The system of claim 1 wherein the source of steam supplies steam at a pressure of 5 pounds per square inch or less.

7. The system of claim 1 wherein the outside surfaces of the distal end segment of the steam tube are rounded.

8. The system of claim 1 further comprising flexible tubing between the steam tube and the source of steam.

9. The system of claim 1 wherein the distal end segment is inclined to the horizontal by at least 15 degrees when the system is mounted in a duct.

10. The system of claim 1 wherein the steam tube further comprises a proximal end segment, the proximal end segment being between the source of steam and the distal end segment, the proximal end segment being configured to be inclined relative to the horizontal at an angle of less than 90 degrees when the system is mounted to a duct, and the proximal end segment being angled with respect to the distal end segment.

11. The system of claim 10, wherein the proximal end segment is at a compound angle relative to the distal end segment, such that both segments are not in a horizontal plane when the steam tube is positioned in the duct, and both segments are inclined with respect to the horizontal.

12. The system of claim 1, wherein the lip comprises a bevel.

13. The system of claim 12, wherein the bevel comprises an angle with respect to a radius perpendicular to the centerline of the steam tube of not less than 25 degrees and not more than 75 degrees.

14. The system of claim 1, wherein the lip comprises a step in diameter.

15. The system of claim 1, wherein the steam tube is in fluid communication with the source of steam through a dome.

16. The system of claim 4, further comprising a dome in fluid communication between the reservoir and the steam tube, wherein the dome is configured to support the steam tube so that a distance from the water within the reservoir to the steam tube of at least 3 inches.

17. The system of claim 1, further comprising a baffle between the source of steam and the steam tube.

18. The system of claim 17, wherein the baffle comprises a screen.

19. A steam humidifier system, configured to inject steam into a duct, comprising:

(a) a source of steam, the source of steam comprising:

(i) a reservoir for holding water; and (ii) a heater positioned in the reservoir;

(b) a steam tube in fluid communication with the source of steam, the steam tube comprising:

(i) a distal end segment that is configured to be inclined relative to the horizontal at an angle of less than 90 degrees when the system is mounted to a duct, wherein condensation that forms in the distal end segment drains back to the source of steam;

(ii) the distal end segment defining an opening having a lip on an inside surface of the opening, wherein the lip directs condensation formed at the opening to flow back into the steam tube and back to the source of the steam; and (iii) the outside surfaces of the distal end segment of the steam tube are rounded;

wherein the steam tube is configured to pass through an opening in a duct and be in fluid communication with the duct.

20. A steam humidifier system, configured to inject steam into a duct, comprising:

(a) a source of steam, the source of steam comprising:

(i) a reservoir for holding water; and (ii) a heater positioned in the reservoir;

(b) a steam tube in fluid communication with the source of steam, the steam tube comprising a distal end segment that is configured to be inclined relative to the horizontal at an angle of less than 90 degrees when the system is mounted to a duct, wherein condensation that forms in the distal end segment drains back through the steam tube to the source of steam; and (c) a dome in fluid communication between the reservoir and the steam tube, wherein the dome is configured to support the steam tube so that a distance from the water within the reservoir to the steam tube of at least 3 inches.

21. The system of claim 19, wherein the distal end segment is inclined to the horizontal by at least 15 degrees when the system is mounted in a duct.

* * * * *